United States Patent [19]

Österberg

[11] Patent Number: 4,501,303

[45] Date of Patent: Feb. 26, 1985

[54] FORMING FABRIC

[75] Inventor: Lars B. Österberg, Halmstad, Sweden

[73] Assignee: Nordiskafilt AB, Halmstad, Sweden

[21] Appl. No.: 388,345

[22] Filed: Jun. 14, 1982

[30] Foreign Application Priority Data

Jun. 23, 1981 [SE] Sweden ..... 8103920

[51] Int. Cl.[3] ..... D03D 15/02

[52] U.S. Cl. ..... 139/425 A; 139/383 A; 428/221; 428/224; 428/257

[58] Field of Search ..... 139/383 A, 425 A, 408–413; 428/224, 257, 221

[56] References Cited

U.S. PATENT DOCUMENTS

| | | | |
|---|---|---|---|
| 2,157,082 | 5/1939 | Milnes | 139/413 |
| 2,924,252 | 2/1960 | Baron | 139/413 |
| 2,934,097 | 4/1960 | Hindle et al. | 139/408 |
| 3,214,326 | 10/1965 | Lee | 139/383 A |
| 3,885,602 | 5/1975 | Slaughter | 139/425 A |
| 3,885,603 | 5/1975 | Slaughter | 139/425 A |
| 4,314,589 | 2/1982 | Buchanan et al. | 139/383 A |

*Primary Examiner*—James J. Bell

*Attorney, Agent, or Firm*—Kane, Dalsimer, Kane, Sullivan & Kurucz

[57] ABSTRACT

A forming fabric comprising an upper layer which is intended to serve as the paper-forming side and consists of thinner yarns, and a bottom layer which consists of coarser yarns. The two layers are interconnected in that threads form the upper layer alternately pass downwardy to interweave with the bottom layer and in the upper layer replace one another in such a manner that together these threads form the same weave pattern with the upper layer as the rest of the yarns in that layer, which yarns do not interweave with the bottom layer.

4 Claims, 4 Drawing Figures

FORMING FABRIC

BACKGROUND OF THE INVENTION

The invention concerns a double-layer type of forming fabric for use in papermaking, cellulose and similar machines. The forming fabric consists of two complete weaves, each one comprising its separate sets of respective warp and weft threads. The first weave, the top cloth, which in the position of use of the fabric faces the material being formed is made from thinner threads than the second weave, the bottom cloth.

In the production of paper in a papermaking machine a slurry of fibres suspended in large quantities of water is discharged in a flow onto a wire or cloth of mesh-like construction. The wire allows through-flow of the water of the slurry but not of the fibres therein. The fibres therefore collect on the upper face of the fabric and are formed into a web or sheet of paper. To avoid marking on the paper sheet being formed as well as loss of fibres, the paper-forming side of the fabric must be a fine-mesh weave. However, fine-mesh wires made from thin threads are less resistent to wear and abrasion and are also less stable than are coarser weaves. The requirements that the paper-forming side of the fabric must meet thus are in conflict with the requirements regarding the opposite side of the fabric, that is, the side that travels in contact with guide rolls and suction boxes in the papermaking machine, where the fabric is exposed to considerable friction and wear. To solve these problems of conflicting requirements double layer fabrics have been constructed that consist of two complete weaves, one of which is a fine-mesh weave comprising the paper-forming side of the fabric, and the other one a courser weave comprising the opposite side of the fabric. These two layers are interconnected either by warp threads that are part of the thread systems of either one of the two weaves, or by separate binder threads. However, the use of a warp thread that is part of the fine-mesh wire layer as the interconnecting thread causes unevenness on the extremely sensitive paper-forming side of the fabric when at regular intervals the interconnecting warp thread interlaces with a thread in the bottom side of the fabric. On the other hand, the use of a warp thread that is part of the coarser wire layer as the interconnecting thread causes unevenness on the paper-forming side of the fabric when this thread interlaces with the fine-mesh fabric layer that faces the paper web. The best method hitherto conceived to interconnect the two weaves is to use separate binder weft threads which are thinner than those making up the fine-mesh wire part. The inherent problem with the use of binder weft threads of this kind is, however, the abrasive effect that these binder threads have on the threads making up the two weaves, resulting in wear on and ultimately rupture of these threads.

SUMMARY OF THE INVENTION

The purpose of the subject invention is to eliminate these problems, which is achieved in accordance with the teachings of the subject invention by interconnection of the two weaves with the aid of pairs of threads which recur in sequence and which threads from the top cloth alternately pass downwards to interweave with the bottom cloth in such a manner that in the top cloth these threads together form a weave pattern which is identical with the pattern of the rest of the top cloth.

Further characteristics of the invention will appear from the appended claims.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
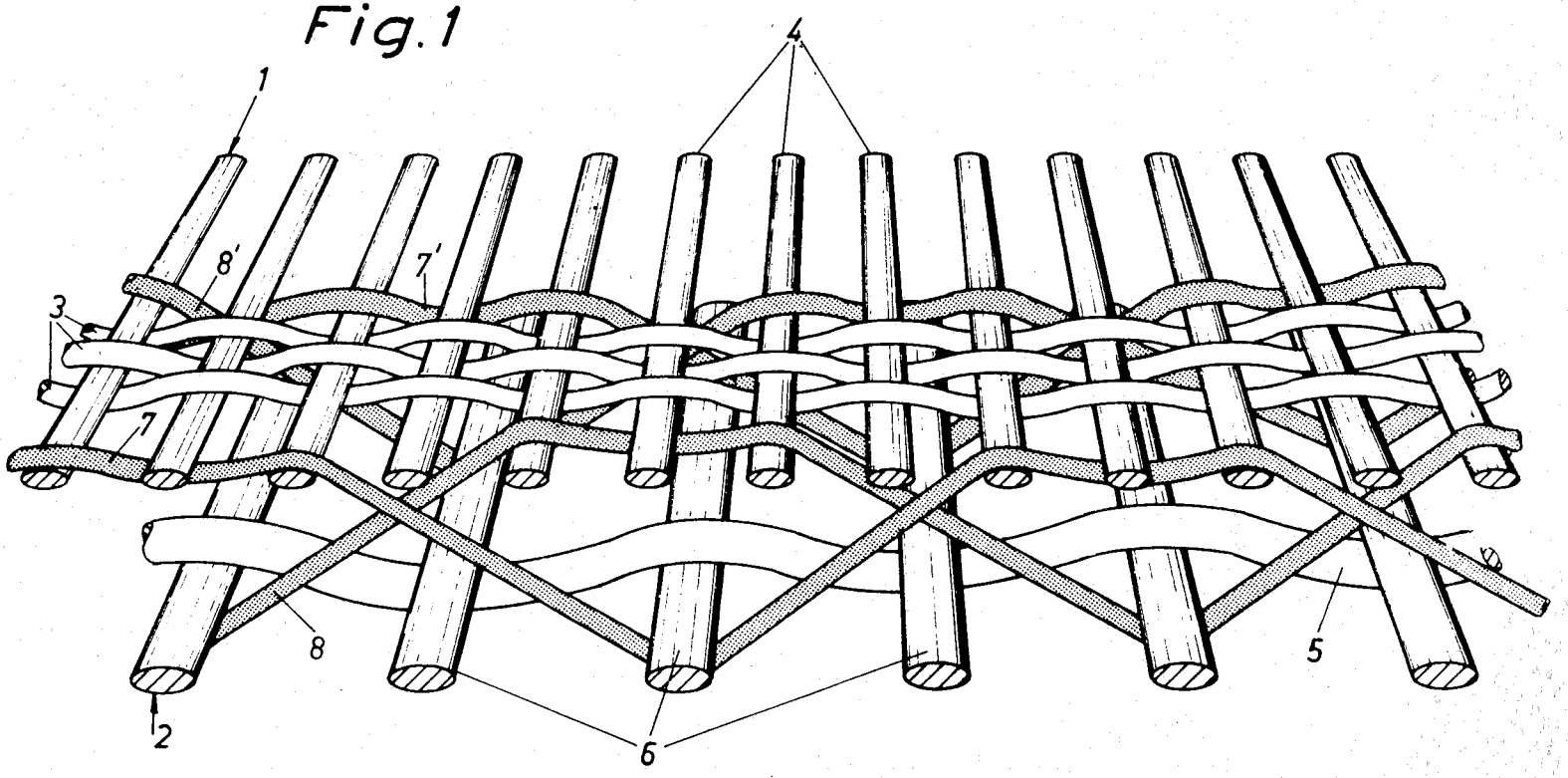
FIG. 1 is a perspective view of the fabric in accordance with a first embodiment.

FIG. 1 shows a part of a fabric in accordance with the invention, the fabric-forming threads having been pulled apart to illustrate the thread binding system more clearly. The fabric comprises an upper layer 1, in the following referred to as the top cloth, on the upper face of which the fibres of the paper slurry collect to form the paper sheet. The fabric further comprises a lower layer 2, in the following referred to as the bottom cloth. The top cloth 1 is made up of warp threads 3 and weft threads 4, and the bottom cloth 2 likewise is made up of warp threads 5 and weft threads 6. In accordance with prior art teachings the threads 3, 4 forming the top cloth 1 are finer than the threads 5, 6, forming the bottom cloth 2. In addition, the top cloth 1 is a finer-mesh cloth than is the bottom cloth 2. Owing to this arrangement the top cloth 1 does not cause marking on the paper sheet being formed thereon while at the same time the bottom cloth 2 will be imparted improved stability and wear resistance because it is made from coarser threads 5 and 6 than the top cloth 1.

Figure 2:
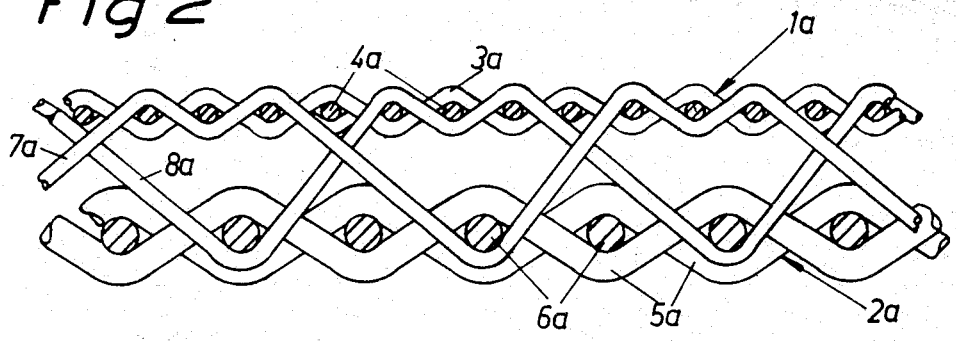
FIGS. 2, 3, and 4 are lateral views of modified forming fabrics in accordance with the invention.
Figure 3:
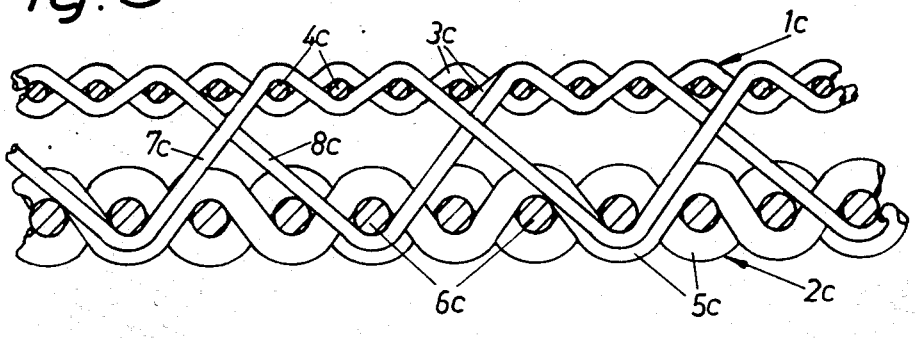
Figure 4:
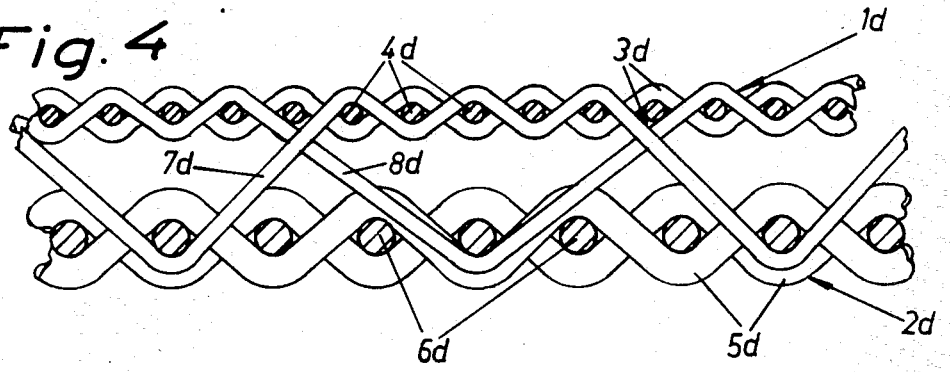

In accordance with the teachings of the invention the interconnection of the two weaves, that is, the top cloth 1 and the bottom cloth 2, is achieved in that pairs of threads 7 and 8 from the top cloth alternately pass downwards to interweave with weft threads 6 in the bottom cloth 2 and with weft threads 4 in the top cloth 1. When one of these threads 7 and 8 is carried downwards to interweave with the bottom cloth 2, the other thread of the pair is carried upwards into the top cloth 1, where it replaces the first thread in accordance with the adopted weave pattern. In the top cloth, the two threads of the pair thus together weave in a pattern that matches the adopted weave pattern formed by the "regular" top cloth threads that do not interconnect the two weaves. In the weave pattern shown by way of example in FIG. 1 the warp threads 7 and 8 bind in a two-shaft weave pattern with the weft threads 4, which is the weave pattern matching the two-shaft weave pattern that warp threads 3 form with the same weft threads 4. The interlacing is repeated after a predetermined number of "regular" warp threads 3, as indicated by binder warp threads 7' and 8' (in FIG. 1). These binder warp threads 7', 8' preferably are displaced relative to the binder warp threads 7, 8. It should be understood that the displacement of the warp threads 7 and 8 that interconnect the two cloths 1 and 2 is carried out throughout the entire top cloth surface. The invention is not limited to the weave pattern illustrated but is equally applicable to other basic weave patterns. FIGS. 2–4 show various kinds of weave patterns.

FIG. 2 illustrates the situation when in the top cloth 1 there are two weft threads 4*a* for each weft thread 6*a* in the bottom cloth 2*a*. A possible weave pattern is indicated by warp threads 7*a* and 8*a* from the top cloth 1*a*.

FIG. 3 shows the solution in accordance with the invention of the problem which in the top cloth 1 there are four weft threads 4*c* for three weft threads 6*c* in the bottom cloth 2*c*.

Finally, FIG. 4 shows the corresponding situation when in the top cloth 1*d* there are five weft threads 4*d* for four weft threads 6*d* in the bottom cloth 2*d*.

The invention is not limited to the embodiments as shown and described but various modifications and variations are possible within the scope of the appended claims. For instance, other quantitive relations of top cloth weft threads to bottom cloth weft threads are possible. The illustrated examples show two-shaft weave patterns only but it should be obvious to the artisan without detailed explanation that this weave pattern is but an example and that a number of other weave patterns are possible. FIG. 1 shows the manner in which two warp threads 7 and 8 and 7' and 8', respectively, interconnect the top cloth and the bottom cloth 2 and also shows that between two such thread pairs are arranged three threads weaving according to the "regular" pattern. This relationship can of course be varied in many different ways. In the description the binder threads 7 and 8 serve as warp threads but the inventive idea also embraces weave structures in which the binder threads 7 and 8 are weft threads.

What I claim is:

1. An improved double-layer type of forming fabric for use in papermaking, cellulose and similar machines, said forming fabric consisting of two integral weaves, each one of said weaves comprising its separate sets of respective warp threads and weft threads, the first one of said weaves, the top cloth, arranged in the position of use of said fabric to face the material being formed, said top cloth being made up by thinner threads than the second one of said weaves, the bottom cloth, the improvement comprising sequestial positions in the pattern of said top cloth where a thread in the weave thereof does not appear, pairs of adjacent additional threads running in the same direction and interconnecting said first and second weaves, said pairs of threads repeating in sequence and alternately passing downwards from said top cloth to interweave with said bottom cloth, each of said respective pairs interweaving with said top cloth in one of said sequential positions whereby to complete the pattern of said top cloth.

2. An improved forming fabric as claimed in claim 1, comprising a thread interlacing with cross-wise threads in said top cloth in the regular manner without passing down to interweave said bottom cloth, each pair of threads of said pairs of threads that pass from said top cloth downwardly to interweave with said bottom cloth being separated from the subsequent one of said pairs of threads by at least one thread of this kind.

3. An improved forming fabric as claimed in claim 2, comprising displacing relative to one another said pairs of threads passing downwardly from said top cloth to interweave with said bottom cloth.

4. An improved forming fabric as claimed in claim 1 comprising a first thread of said pair interweaving with at least one thread of said top cloth and passing downwardly to interweave with at least one thread of said bottom cloth, a second thread of said pair interweaving with at least one thread of said bottom cloth and passing upwardly to interweave with at least one thread of said top cloth, said second thread passing upwardly as said first thread passes downwardly.

* * * * *